US011104465B2

(12) United States Patent
Spindler et al.

(10) Patent No.: US 11,104,465 B2
(45) Date of Patent: Aug. 31, 2021

(54) INSTALLATION FOR THE TREATMENT OF CONTAINERS, AND METHOD FOR PACKAGING FILLED CONTAINERS

(71) Applicant: KRONES AG, Neutraubling (DE)

(72) Inventors: Herbert Spindler, Neutraubling (DE); Martin Bauer, Neutraubling (DE)

(73) Assignee: KRONES AG, Neutraubling (DE)

( * ) Notice: Subject to any disclaimer, the term of this patent is extended or adjusted under 35 U.S.C. 154(b) by 259 days.

(21) Appl. No.: 16/313,620

(22) PCT Filed: Mar. 13, 2017

(86) PCT No.: PCT/EP2017/055768

§ 371 (c)(1),
(2) Date: Dec. 27, 2018

(87) PCT Pub. No.: WO2018/001577

PCT Pub. Date: Jan. 4, 2018

(65) Prior Publication Data

US 2019/0225359 A1 Jul. 25, 2019

(30) Foreign Application Priority Data

Jun. 28, 2016 (DE) ..... 10 2016 211 619.3

(51) Int. Cl.
*B65B 21/24* (2006.01)
*B65B 53/06* (2006.01)
(Continued)

(52) U.S. Cl.
CPC ..... *B65B 57/04* (2013.01); *B65B 21/245* (2013.01); *B65B 35/44* (2013.01); *B65B 41/16* (2013.01);
(Continued)

(58) Field of Classification Search
CPC ..... B65B 57/02; B65B 57/04; B65B 57/10; B65B 57/12; B65B 57/14; B65B 59/00;
(Continued)

(56) References Cited

U.S. PATENT DOCUMENTS 3,531,907 A 10/1970 Smith et al.
5,031,298 A * 7/1991 Fresnel ..... B65B 53/063 29/447
(Continued)

FOREIGN PATENT DOCUMENTS

CN 102050243 A 5/2011
CN 102198868 A 9/2011
(Continued)

OTHER PUBLICATIONS

Why does heat lose its energy as we get further away—published by Physics in Dec. 2014, retrieved from URL https://physics.stackexchange.com/questions/154428/why-does-heat-lose-its-energy-as-we-get-further-away on Feb. 9, 2021 (Year: 2014).*
(Continued)

*Primary Examiner* — Valentin Neacsu
(74) *Attorney, Agent, or Firm* — McCoy Russell LLP

(57) ABSTRACT

In an installation for the treatment of containers, comprising at least one filling station and a packing station for processing film or packaging material blanks and having work components acting upon the packaging material and forming packages, at least one measuring device for dimensional deviations of filled containers, and a control unit for automatically adjusting at least one installation station depending on a dimensional deviation detected, work components in the packing station (P) acting upon the packaging material when the filled containers are packed are automatically adjustable by way of the control unit. In a method for packing filled containers, work components of the packing
(Continued)

station acting upon packaging material are adjusted automatically depending on dimensional deviations measured in order to form packages of different dimensions with at least substantially the same packing density.

13 Claims, 2 Drawing Sheets

(51) Int. Cl.

| | |
|---|---|
| ***B65B 57/04*** | (2006.01) |
| ***B65B 57/12*** | (2006.01) |
| ***B65B 59/02*** | (2006.01) |
| ***B65B 35/44*** | (2006.01) |
| ***B65B 43/14*** | (2006.01) |
| ***B65B 57/02*** | (2006.01) |
| ***B65B 41/16*** | (2006.01) |
| ***B65B 43/12*** | (2006.01) |
| ***B65B 57/10*** | (2006.01) |
| ***B65B 59/00*** | (2006.01) |
| *B65B 49/14* | (2006.01) |
| *B65B 3/00* | (2006.01) |

(52) U.S. Cl.
CPC ..... *B65B 43/126* (2013.01); *B65B 43/145* (2013.01); *B65B 53/063* (2013.01); *B65B 57/02* (2013.01); *B65B 57/10* (2013.01); *B65B 57/12* (2013.01); *B65B 59/003* (2019.05); *B65B 59/02* (2013.01); *B65B 3/00* (2013.01); *B65B 49/14* (2013.01); *B65B 2210/02* (2013.01); *B65B 2210/04* (2013.01)

(58) Field of Classification Search
CPC ..... B65B 59/02; B65B 59/005; B65B 59/003; B65B 53/063; B65B 2210/04; B65B 21/245
USPC ..... 53/442
See application file for complete search history.

(56) References Cited

U.S. PATENT DOCUMENTS

| | | | | |
|---|---|---|---|---|
| 6,964,149 | B2 * | 11/2005 | Iwamura | B65B 5/024 53/504 |
| 9,517,853 | B2 * | 12/2016 | Koolhaas | B65B 21/245 |
| 2006/0070997 | A1 * | 4/2006 | Sjoholm | B65B 55/18 220/254.7 |
| 2012/0210674 | A1 * | 8/2012 | Perl | B65B 13/22 53/396 |
| 2013/0000256 | A1 * | 1/2013 | Schilling | F27B 9/10 53/442 |
| 2014/0088759 | A1 * | 3/2014 | Hahn | B65G 21/20 700/230 |
| 2014/0237944 | A1 * | 8/2014 | Hahn | B67B 3/26 53/411 |
| 2014/0272747 | A1 * | 9/2014 | Ciurkot | B65B 65/06 432/239 |
| 2014/0298100 | A1 * | 10/2014 | Grimm | B67B 3/26 714/37 |
| 2014/0331617 | A1 * | 11/2014 | Napravnik | G01N 21/8806 53/463 |
| 2014/0345235 | A1 * | 11/2014 | Yamazaki | B65B 57/00 53/462 |
| 2015/0059290 | A1 * | 3/2015 | Ewert | B65B 11/48 53/432 |
| 2016/0122058 | A1 * | 5/2016 | Smith | B65B 65/06 53/557 |
| 2018/0326623 | A1 * | 11/2018 | Winzinger | B65B 59/001 |

FOREIGN PATENT DOCUMENTS

| | | | |
|---|---|---|---|
| CN | 103930350 | A | 7/2014 |
| CN | 104015961 | A | 9/2014 |
| CN | 104053600 | A | 9/2014 |
| CN | 105667862 | A | 6/2016 |
| DE | 60300126 | T2 | 3/2005 |
| DE | 102011017448 | A1 | 10/2012 |
| DE | 102011050715 | A1 | 12/2012 |
| DE | 102011084135 | A1 | 4/2013 |
| DE | 102011054890 | A1 | 5/2013 |
| DE | 102014112341 | A1 | 3/2016 |
| EP | 1959228 | A1 | 8/2008 |
| EP | 2368801 | A1 | 9/2011 |
| EP | 2489597 | A1 | 8/2012 |
| EP | 2772445 | A1 | 9/2014 |
| EP | 2805892 | A1 | 11/2014 |

OTHER PUBLICATIONS

ISA European Patent Office, International Search Report Issued in Application No. PCT/EP2017/055768, dated Jun. 13, 2017, WIPO, 6 pages.

China National Intellectual Property Administration, Office Action and Search Report Issued in Application No. 201780039885.8, dated May 19, 2020, 27 pages. (Submitted with Partial Translation).

* cited by examiner

INSTALLATION FOR THE TREATMENT OF CONTAINERS, AND METHOD FOR PACKAGING FILLED CONTAINERS

CROSS-REFERENCE TO RELATED APPLICATIONS

The present application is a U.S. National Phase of International Patent Application Serial No. PCT/EP2017/055768 entitled "INSTALLATION FOR THE TREATMENT OF CONTAINERS, AND METHOD FOR PACKAGING FILLED CONTAINERS," filed on Mar. 13, 2017. International Patent Application Serial No. PCT/EP2017/055768 claims priority to German Patent Application No. 10 2016 211 619.3 filed on Jun. 28, 2016. The entire contents of each of the above-referenced applications are hereby incorporated by reference for all purposes.

DESCRIPTION

Technical Field

The invention relates to an installation for the treatment of containers, in particular PET bottles (PET), and to a method for packaging filled containers in an installation for the treatment of said containers.

BACKGROUND AND SUMMARY

In an installation for the treatment containers known from DE 102011084135 A1, a method is carried out in which dimensional deviations of containers are measured and installation stations are adjusted automatically by way of a control unit depending on the dimensional deviations of the containers detected. Once the container diameter has been determined, the container inlet at the packing station can be adjusted accordingly. However, since no work components of the packing station processing the packaging material are adjusted, the dimensional deviations of the containers and/or of the packaging material in the packing station can cause jamming or faulty packages to be formed, for example, with the packing density being too high or too low. For this reason, operators of the installation must then accordingly readjust at least work components of the packing station processing packaging material should faulty packages be ejected, which leads to a long retrofit time or to the ramp-up time being too long and inevitably causes significant discard. In addition, this requires well-trained operating staff who have to decide for each case when and how the packing station is to be readjusted.

Also of interest are EP 1959228 B1, DE 1020110174P8 A1.

The invention is based on the object of providing an installation of the type mentioned above and a method for packaging filled containers which make it possible to reduce the ramp-up time in order to lower the discard rate of faulty packages, and operate without specially trained operating staff.

The object posed is satisfied with an installation for treatment of containers, in particular PET bottles (PET), with several installation stations comprising at least one filling station and at least one packing station for processing film or packaging material blanks, with work components acting upon the packaging material and forming packages, at least one measuring device at least for detecting dimensional deviations of the containers, and a control unit for automatically adjusting at least one installation station depending on at least one dimensional deviation of the containers detected, wherein at least work components in the packing station acting upon the packaging material are automatically adjustable by way of the control unit when packing filled containers; and according to method for packing filled containers in an installation for treatment of the containers, in particular PET bottles (PET), wherein the installation comprises at least one filling station and at least one packing station for processing film packaging material or packaging material blanks with work components acting upon the packaging material when forming packages, and at least one measuring device at least for detecting dimensional deviations from a target dimension of containers to be packed, and a control unit for automatically adjusting at least one station of the installation depending on at least the detected dimensional deviations of the containers, wherein when detecting a container dimensional deviation work components acting at least upon the packaging material in the packing station are adjusted automatically depending of the container dimensional deviation such that in the packing station packages differing in size according to the measurement results but having substantially the same packing density are formed Since work components processing the packaging material are adjusted automatically in the installation, at least in the packing station, depending on at least one dimensional deviation of the filled containers detected, jamming in the packing station is eliminated and the ramp-up time can be reduced significantly.

Since at least the work component in the packing station processing the packaging material is adjusted automatically in the method depending on dimensional deviations of at least the containers detected, no trained operating staff needs to intervene and the discard rate of faulty packages is reduced noticeably.

Dimensional deviations of the filled containers can result from the filling operation or the content of the containers, or from fluctuating quality of the containers or from varying pressure situations in or at installation stations.

In one embodiment of the installation, the temperature acting upon the film packaging material in a shrink tunnel of the packing station can be adjusted, can preferably be raised when container undersize relative to a target dimension has been detected and be lowered when oversize has been detected. This prevents the formation of tears in the shrunken film packaging material, damage to containers, or the packing density in the package being too low.

At least one railing and a lane guide are advantageously adjustable by way of the control unit in a container inlet of the packing station, at least one single-piece lane guide and a container guide strip are adjustable in a container treatment section, preferably when oversize toward the outside has been determined and undersize toward the inside has been determined. This ensures a correct container flow without any congestion or slackening.

In one embodiment, at least one tunnel wall is adjusted outwardly or inwardly when the temperature acting in the shrink tunnel is adjusted to adapt a distance of containers from the tunnel walls. A substantially uniform packing density is thus achieved without jamming or slack.

Furthermore, the internal pressure and/or the external pressure can be measured, at least when detecting dimensional deviations of containers. When taking into account the external pressure, the internal pressure allows for a relatively accurate conclusion about the occurrence of a dimensional deviation of the container.

In a further embodiment of the installation, in which packages are formed using packaging material blanks, at least one further measuring device for detecting a dimensional deviation of the packaging material blanks, in particular cardboard blanks, is provided and linked to the control unit. Work components acting upon the packaging material blanks can then be adjusted automatically by way of the control unit, at least in the packing station, based on a comparison of dimensional deviations of containers detected and/or dimensional deviations of packaging material blanks detected in order to avoid jamming in the packing station and/or faulty packages.

It is advantageous to use the further measuring device to detect an oversize or undersize relative to a target dimension of the packaging material blanks in terms of thickness and/or size, preferably even by way of humidity measurement and/or external pressure measurement.

It can there be advantageous for at least one chamber wall of a blanks handling section to be adjustable toward the outside when oversize of the packaging material blanks has been detected by the control unit, and preferably, at least one blanks guide of a blanks handling section toward the outside, and preferably at least one glue nozzle and/or a pressure bar in a package handling section toward the outside, and respectively adjustable toward the inside when undersize has been detected.

The respective measuring device advantageously comprises at least one camera, preferably a CCD camera. The measuring device for the packaging material blanks can comprise a humidity sensor.

In order to be able to react to the extent possible in real time to dimensional deviations detected, it is advantageous for work components acting upon the packaging material to be adjustable at least in the packing station by way of electrical servo drives and/or actuators.

Two variants are conceivable for the packing station of the installation One variant comprises a combination packing station which optionally forms packages with film packaging material or packing material blanks. The other variant is a simple packing station which either processes only film packaging material or only packaging material blanks.

In an advantageous variant of the method, the temperature acting upon film packaging material in a shrink tunnel of the packing station is adjusted and, preferably, also the distance between containers and the tunnel walls is adjusted accordingly, in order to avoid jamming or faulty packages.

Finally, it can be advantageous if also or only dimensional deviations of packaging material blanks, preferably cardboard blanks, are measured in accordance with the method and taken into account during the adjustment of the work components acting upon the packaging material blanks in the packing station, in order to prevent jamming in the packing station, the packing density being too high with the risk of tears forming in the packaging material, or to avoid the packing density being too low with loose containers.

BRIEF DESCRIPTION OF THE FIGURES

Embodiments of the invention shall be explained with reference to the drawings, where.

DETAILED DESCRIPTION

Figure 1:
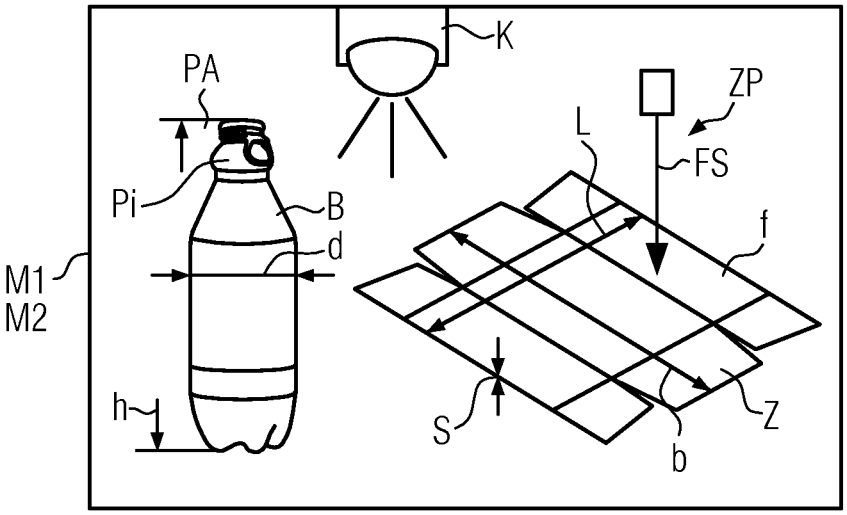
FIG. 1 shows schematically at least one measuring device for detecting dimensional deviations of filled containers and/or packaging material.

FIG. 1 shows schematically a measuring device M1, M2, for example in an installation A for the treatment of containers according to FIG. 2, and is used for a better understanding of a method explained with reference to the further figures for packing filled containers B to form packages in installation A.

For example, a camera K, preferably a CCD camera, is provided in measuring station M1 and detects dimensional deviations of every container B, for example, a filled PET bottle PET [sic]. Sensors (not shown) for measuring the internal pressure pi and/or the external pressure pa can also be provided in measuring device M1, and, for example, the diameter d and the height h of container B are detected.

For example, in a further measuring device M2, dimensional deviations of packaging material blanks ZP, presently, for example, a cardboard blank Z, are determined using a camera K, namely with respect to e.g. the length L and/or the width b and/or the thickness S, and/or the humidity f which is determined, for example, by way of a humidity sensor FS. The relative humidity f of the packaging material blanks can namely lead to outline enlargement or reduction or increasing or decreasing thickness.

Such dimensional deviations from a target dimension (default setting of the packing station) can lead to packing disruptions.

As shall be explained later, in particular work components acting upon the packing material in the packing station are adjusted based on the measurement results of measuring device M1, M2. This is performed automatically in real time by way of installation control unit CU to avoid jamming in the packing station and/or faulty packages without any staff being involved.

Figure 2:
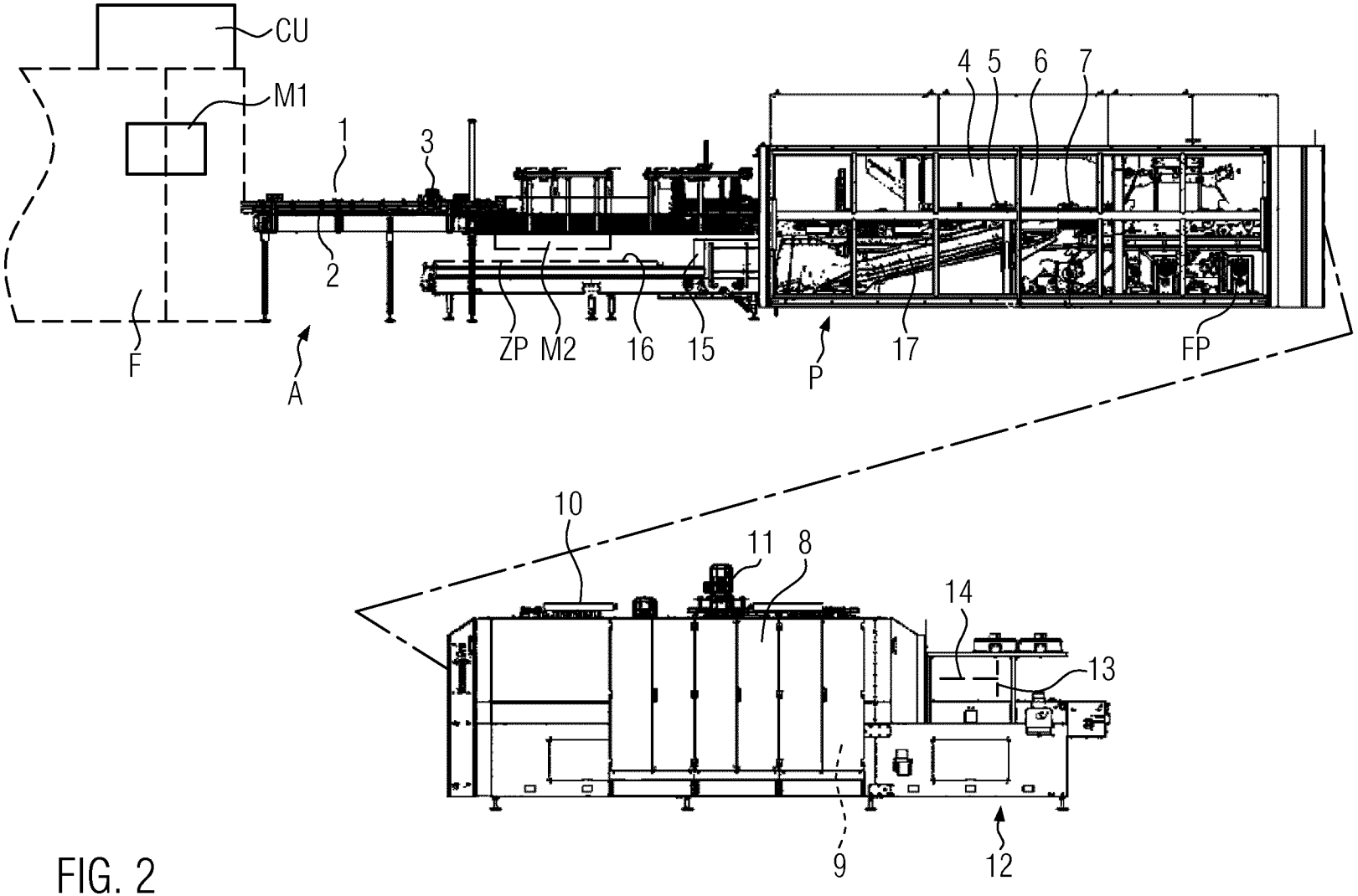
FIG. 2 shows a schematic side view of an installation for the treatment of containers, where a packing station is highlighted, presently a combination packing station for selectively processing packaging material blanks or film packaging material, when forming packages composed of containers and packaging material.

Installation A for the treatment of containers schematically indicated in FIG. 2 comprises several mutually interacting installation stations, including at least one filling station F in which or downstream of which measuring device M1 can be arranged, and at least one packing station P with a downstream package handling section 12.

Packing station P shown in FIG. 2 is a combination packing station, meaning that packaging material blanks ZP, preferably cardboard blanks Z, or film packaging material FP, for example shrink film, are/is optionally processed. Alternatively, the packing station could also be configured for processing only packaging material blanks ZP or only film packaging material FP.

Figure 3:
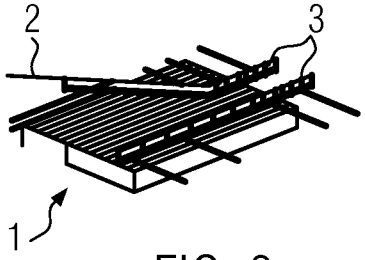
FIG. 3 shows a detail of the packing station.

Arranged in a container inlet 1 of packing station P are railings 2 and lane guides 3 which are adjustable according to FIG. 3 when a dimensional deviation of a container has been detected transversely to the direction of passage. At least one railing 2 and at least one lane guide 3 are adjusted toward the outside when container oversize has been detected and toward the inside when container undersize has been detected.

Figure 4:
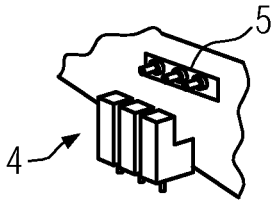
FIG. 4 shows a further detail of the packing station.

Provided downstream of container inlet 1 is a container handling section 4 in which single-part lane guides 5 are provided which are adjustable toward the inside or the outside according to FIG. 4 depending on whether oversize or undersize has been detected.

Figure 5:
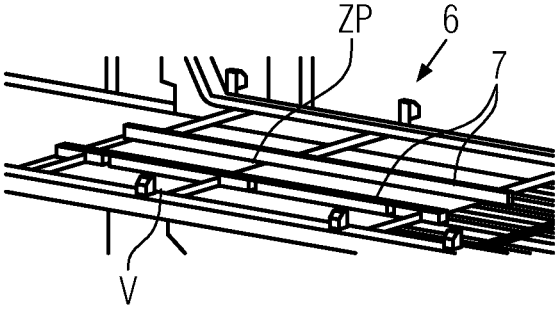
FIG. 5 shows a further detail of the packing station.

In a further part 6 of the container handling section, guide strips are contained which are adjustable according to FIG. 5 toward the inside or the outside depending on a dimensional deviation detected.

Figure 6:
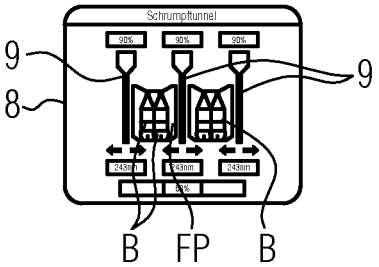
FIG. 6 shows a further detail of the packing station, presently a shrink tunnel.
Figure 7:
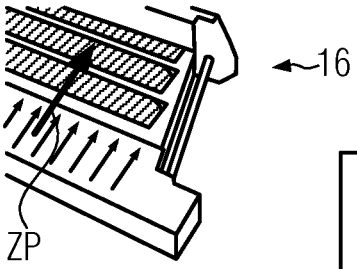
FIG. 7 shows a further detail of the packing station, each in a perspective illustration.

Provided further downstream is a shrink tunnel 8 which, according to FIG. 6, comprises tunnel walls 9 that are adjustable transversely to the direction of passage, as well as heating devices 10 and, for example, a fan 11 for adjusting the temperature acting in shrink tunnel 8. Depending on a dimensional deviation of containers B detected, preferably outside a predetermined tolerance range, the temperature acting in shrink tunnel 8 is reduced and tunnel walls 9 are adjusted toward the outside when oversize has been detected whereas the temperature acting in shrink tunnel 8 is increased and tunnel walls 9 are adjusted toward the inside when undersize has been detected so that equal distances between containers B and tunnel walls 9 are respectively given.

In package handling section 12 indicated downstream in FIG. 2, the shrunken packages are conveyed away when packing using film packaging material FP is performed, whereas the packages are completed using glue nozzles 13 and pressure bars 14 when packaging material blacks ZP made of cardboard are used. Depending on a dimensional deviation of containers B detected and/or the packaging material blanks ZP, glue nozzles 13 and pressure strips 14 are adjusted accordingly in package handling section 12 in order to form faultless packages.

In a blanks handling section 16 arranged downstream of container inlet 1, packaging material blanks ZP are made available individually or in a stacked manner (the further measuring device M2 can be provided there), and cardboard blanks Z are conveyed individually to sections 5, 6 of the container handling section, as indicated in FIG. 5. Chamber walls 15 and blank guides 17 are then used which can be adjust transversely to the direction of passage toward the outside or the inside. Shrink tunnel 8, if present, is inoperative when packaging is effected using packaging material blanks ZP. On the other hand, folding and wrapping work components, not shown, e.g. punches and the like, are provided for packaging material blanks ZP and shape packaging material ZP for the package which is finally completed in package handling section 12, for example, using glue from glue nozzles 13 and using pressure bars 14, and is then discharged.

The adjustments in packing station P relating to the transport of containers are performed about the same regardless of the packaging material ZP or FP. Film packaging material FP can furthermore made available in a roll upstream of shrink tunnel 8, as indicated in FIG. 2. The roll can optionally be moved to and fro by a servo drive across the unwinding direction. Work components acting upon the filled containers and/or the packaging material can be adjusted automatically in packing station P by way of electric drives using control unit CU of installation A.

The invention claimed is:

1. An installation for treatment of containers, with several installation stations comprising at least one filling station for filling each container and at least one packing station for processing packaging material blanks, with work components acting upon the packaging material blanks and forming packages of several filled containers, at least one measuring device at least for detecting dimensional deviations of each filled container from a target dimension, and a control unit for automatically adjusting at least one installation station depending at least on detected dimensional deviations of the filled containers, wherein work components in the packing station acting upon the packaging material blanks are automatically adjustable by way of the control unit when packing the filled containers, wherein at least one further measuring device is provided for detecting a dimensional deviation of the packaging material blanks from a target dimension and is linked to the control unit, and wherein the work components acting upon the packaging material blanks are automatically adjustable in the packing station by the control unit on the basis of a comparison of detected dimensional deviations of each filled container and detected dimensional deviations of the packaging material blanks, and wherein the further measuring device detects an oversize or an undersize as compared to the target dimension of the packaging material blanks in terms of thickness and/or size.

2. The installation according to claim 1, wherein in a container inlet of the packing station at least one railing and a lane guide, and in a downstream container handling section, at least one single-piece lane guide and at least one container guide strip are adjustable by the control unit.

3. The installation according to claim 2, wherein the single-piece lane guide and the container guide strip are adjustable toward an outside when a container oversize has been detected and toward an inside when a container undersize has been detected.

4. The installation according to claim 1, wherein an internal pressure of the filled container and/or an external pressure around the filled container is/are measurable when detecting dimensional deviations of the filled container.

5. The installation according to claim 4, wherein the camera is a CCD-camera.

6. The installation according to claim 1, wherein at least one chamber wall of a packaging material blanks handling section is adjustable by the control unit toward the outside, wherein at least one glue nozzle and/or a pressure bar in a downstream package handling section is/are adjustable toward the outside by the control unit, respectively, when an oversize of the packaging material blanks has been detected, and wherein the chamber wall, the glue nozzle and/or the pressure bar respectively are adjustable toward an inside when an undersize of the packaging material blanks has been detected.

7. The installation according to claim 1, wherein the respective measuring device of the one and the further measuring devices comprise at least one camera.

8. The installation according to claim 1, wherein the work components of the packing station acting upon the packaging material blanks are adjustable by way of electrical servo drives and/or regulated actuators.

9. The installation according to claim 1, wherein the filled containers are PET-bottles.

10. The installation according to claim 1, wherein the packaging material blanks are cardboard blanks, and wherein the oversize or the undersize of the cardboard blanks is detected by a humidity measurement with the further measuring device.

11. A method for packing filled containers in an installation for treatment of the containers, wherein the installation comprises at least one filling station for filling the containers and at least one packing station for processing packaging material blanks with work components acting upon the packaging material blanks when forming packages of several filled containers, and a measuring device for detecting of each filled container to be packed dimensional deviations from a target dimension, and a further measuring device for detecting a dimensional deviation of the packaging material blanks from a target dimension, both being linked to a control unit for automatically adjusting at least one station of the installation depending on the detected dimensional deviations of each filled container and the detected dimensional deviations of the packaging material blanks, wherein when detecting a filled container dimensional deviation and a dimensional deviation of the respective packaging material blank work components acting at least upon the packaging material blank in the packing station are adjusted automatically depending on a comparison between the container dimensional deviations detected and the packaging material blank dimensional deviations detected such that in the packing station packages differing in size according to the detected dimensional deviations but having substantially the same packing density in the package are formed.

12. An installation for treatment of containers, with several installation stations comprising at least one filling station for filling each container and at least one packing station including a shrink tunnel for processing film packaging material by temperature action for forming shrunk-in packages from several filled containers, at least one measuring device for detecting dimensional deviations of each filled container from a target dimension, and a control unit for automatically adjusting at least an installation station depending on detected dimensional deviations of each filled container, wherein a temperature acting upon the film packaging material in the shrink tunnel of the packing station is adjusted and also a distance between the filled containers packed in the film packaging material and tunnel walls of the shrink tunnel is adjusted.

13. The installation according to claim 12, wherein the temperature in the shrink tunnel is raised when a filled container undersize has been detected and is lowered when a filled container oversize has been detected.

* * * * *